United States Patent [19]

Leighton

[11] Patent Number: 4,911,773

[45] Date of Patent: Mar. 27, 1990

[54] METHOD FOR REPAIRING DAMAGED CARPET

[76] Inventor: William F. Leighton, 4350 Beverly Blvd., Los Angeles, Calif. 90004

[21] Appl. No.: 251,760

[22] Filed: Oct. 3, 1988

[51] Int. Cl.[4] ..... B32B 35/00

[52] U.S. Cl. ..... 156/98; 156/94; 427/200; 427/206; 427/140; 428/90; 428/63

[58] Field of Search ..... 156/94, 98; 427/200, 427/206, 140; 428/63, 90

[56] References Cited

U.S. PATENT DOCUMENTS

| | | | |
|---|---|---|---|
| 3,558,384 | 1/1971 | Ronning | 156/98 |
| 3,558,385 | 1/1971 | Ronning | 156/98 |
| 3,558,386 | 1/1971 | Ronning | 156/98 |
| 4,047,300 | 9/1977 | Sweeny, Jr. | 156/98 X |
| 4,058,423 | 11/1977 | Bascom et al. | 156/98 |
| 4,267,219 | 5/1981 | Veno et al. | 428/90 |

*Primary Examiner*—Robert A. Dawson
*Assistant Examiner*—James J. Engel
*Attorney, Agent, or Firm*—James E. Brunton

[57] ABSTRACT

A method for repairing damaged carpet in homes, automobiles, boats and other vehicles. In accordance with the method of the invention, repairs can be made on either flat or curved surfaces and in areas of limited access. Individual fibers are harvested from portions surrounding the defect, are specially treated and then are bonded in place within the boundaries of the defect in a manner to closely match the color, wear characteristics and pattern of the carpet in the area of the defect.

6 Claims, 1 Drawing Sheet

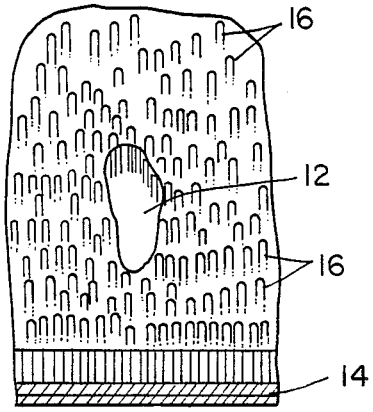
FIG. 1
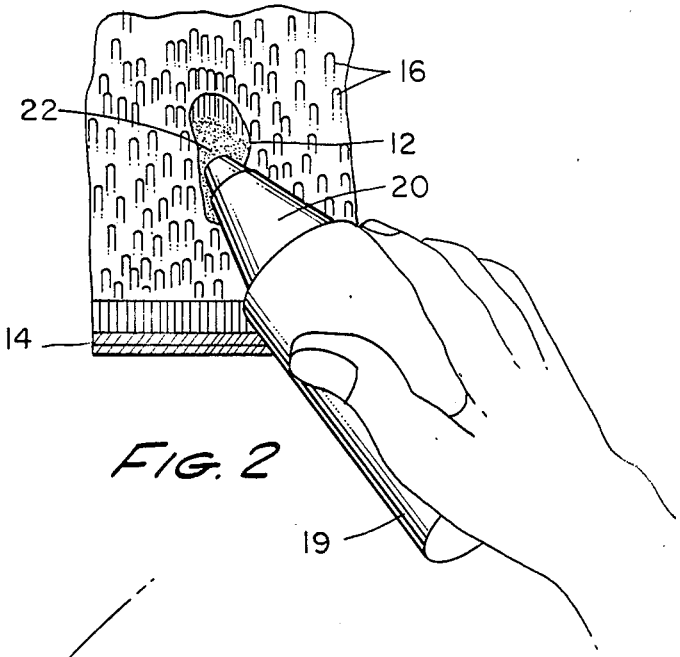
FIG. 2
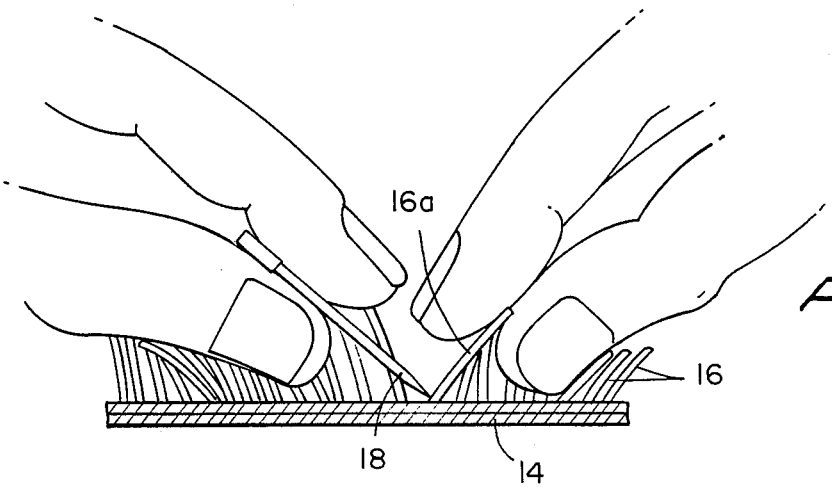
FIG. 3
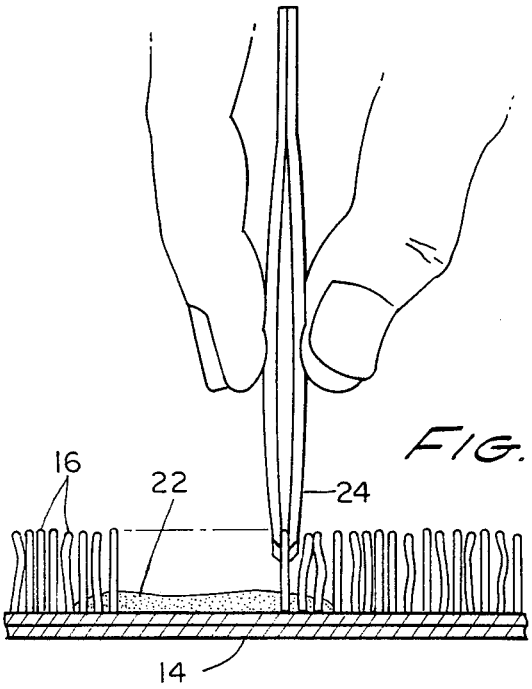
FIG. 4
FIG. 5
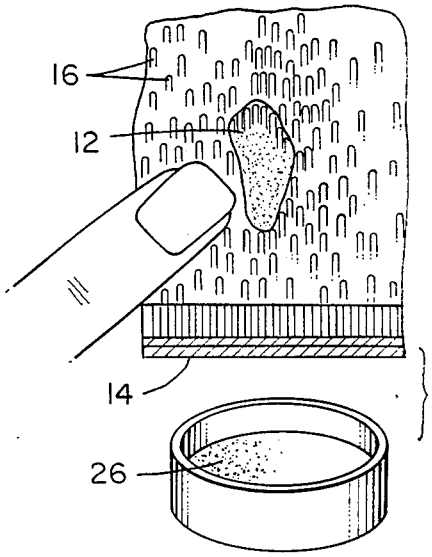

METHOD FOR REPAIRING DAMAGED CARPET

BACKGROUND OF THE INVENTION

1. Field of the Invention

The present invention relates generally to a method for repairing damaged carpet. More particularly the invention concerns a method for repairing a burn in a carpet of the character having a base material supporting an upper fibrous pile.

2. Discussion of the Prior Art

Numerous methods have been proposed in the past for repairing damaged carpet. However, many of the prior art methods are costly, time consuming and require special tools to accomplish the repair. For example, a common prior art method for repairing carpet involves the passing of a rotary cutting tool down through both the pile layer and the layer of supporting material in manner to remove a circular core, or section, embodying the defect. The same cutter is then passed through an undamaged piece of spare carpet of the same color to obtain a circular section of the same size. The section of undamaged carpet is then bonded in place within the opening formed in the carpet where the damaged section was removed. U.S. Pat. No. 3,558,385 issued to Ronning is exemplary of this process.

Another prior art repair method involves the use of a specially designed under-cutting tool which removes an entire section of the pile from the base material in the area of the damage. The undercutiing tool is then used to undercut a section of undamaged pile from another area of the carpet, or from a spare piece of carpet. The undamaged under-cut section is then bonded to the base material in place of the damaged section which was removed. U.S. Pat. No. 3,558,384 issued to Ronning discloses the aforementioned method for carpet repair.

Other methods for repairing carpet and plastic materials include the use of specially designed cutting or coring tools which cut away the damaged area, leaving a hole therethrough. A backing material is then placed behind the hole and the backing material is covered with a curable patching compound or adhesive to which a section of undamaged material of identical size and shape is bonded.

The drawbacks of the prior art methods which require coring out a damaged section of carpet and replacing it with an undamaged cored section are several. In the first place, special tools, normally not available to the typical home owner, are required. Secondly, the core which is taken from the spare piece of carpet, or from a hidden location in the carpet, more often than not does not match the carpet pile in the area of the damage. This is because the color of the carpet in the area of the damage is typically faded and discolored from exposure to sunlight, dirt and wear. Additionally, the pile in the damaged area of the carpet is often matted and abraded providing a markedly different appearance from that of the new, unworn pile section used during the repair. Accordingly, when the new core section is bonded in place, it becomes at once apparent that repair has been attempted.

Another drawback of the prior art methods which involve the use of a coring tool reside in the inability to use the tool in certain locations. For example, when the carpeting in an automobile is burned or otherwise damaged, it may be very difficult to use the tool to cut a core section from the damaged carpet. If the damage is in the area of the drive train hump, which presents a curved surface to the coring tool, the coring out of the damaged section is difficult if not impossible. Similarly, if the damaged area is located proximate the vehicle brake or in a hard to reach corner, the coring tool may be usable, if at all, only with great difficulty.

The method of the present invention overcomes the drawbacks of the prior art by providing a method wherein no coring or other specialized tools are required. In accordance with the method of the present invention, individual fibers are selectively harvested using a razor blade or the like to replace the damaged fibers. By harvesting the individual fibers in selected locations immediately surrounding the damaged area, the fibers will exhibit the same degree of discoloration, fading and wear as the fibers in the location of the defect.

Harvesting of the fibers in accordance with the method of the present invention is readily accomplished by unskilled workman using a common razor blade or other sharp instrument. The fibers are preferably cut near their juncture with the base material so that when bonded in place in the damaged area they will have approximately the same height as the undamaged fibers in the surrounding area. By carefully implanting the fibers in a suitable clear-drying adhesive uniformly spread over the base material, the basic pattern of the pile in the carpet can be closely simulated and, if care is taken in the implanting process, the repaired area is virtually undetectable.

SUMMARY OF THE INVENTION

It is an object of the present invention to provide a method for repairing damaged carpet in houses, automobiles, mobile homes, boats and other vehicles in which no special tools are required and in which the repair can be accomplished quickly and easily by unskilled workman.

It is another object of the invention to provide a method of the aforementioned character in which the fibers used to repair the damage to the carpet have the same color and wear characteristics as the fibers immediately surrounding the damaged area.

Another object of the invention is to provide a method of the character described in which readily available, easy to use materials are used to accomplish the repair.

A further object of the invention is to provide a method for carpet repair which permits the repair of burned or damaged fibers located on curved surfaces and in cramped areas providing limited access. More particularly the method of the invention is ideally suited for repairing damage to automobile carpet on curved surfaces such as on the transmission hump, in areas proximate control peddles and in locations next to the seats where access is extremely limited.

Still another object of the invention is to provide means for repairing lightly colored carpets that have been burned, including the step of applying to the burned area a paint or other tinting material which closely matches the color of the undamaged pile of the carpet. The fibers which are harvested from the carpet in the area surrounding the damage are then bonded in place against the background of the tinted material in a manner to render the repair virtually invisible.

Yet another object of the invention is to provide a method for repairing damaged carpets which is inexpensive, can be quickly and easily accomplished using tools and materials readily available to the home owner.

BRIEF DESCRIPTION OF THE DRAWINGS

FIG. 1 is a generally diagrammatic view of a section of carpet having a defect such as a burn.

FIG. 2 is a generally diagrammatic view illustrating the first step to be followed in repairing the defect, namely the application of a bonding material.

FIG. 3 is a generally diagrammatic view illustrating the next step in the method, namely that of removing individual fibers from locations immediately surrounding the defect.

FIG. 4 is a generally diagrammatic view illustrating the step in the method of the invention of inserting the harvested fibers into the area of the defect.

FIG. 5 is a generally diagrammatic view illustrating the first step in an alternate method of repair.

DESCRIPTION OF THE INVENTION

Referring to the drawings and particularly to FIG. 1, the method of the present invention is directed to the repair of defects in carpet, such as a defect 12. Typically, carpet which is repairable by the method of the present invention includes a base material 14 supporting an upper fibrous layer made up of a multiplicity of fibers 16. Fibers 16, which make up the repairable carpet, can be of any color and can exhibit any degree of fading and wear. When the fibers are particularly light in color, an alternate method of repair can be followed, the details of which will be described hereinafter. Almost any type of carpet can be repaired using the method of the present invention including wool, plastic and various synthetic material carpets.

Turning to FIGS. 2 through 4, the principal method of the present invention is there illustrated. As shown in FIG. 3, the first step of this method of the invention involves carefully harvesting a number of individual fibers from the area immediately surrounding the defect 12. This harvesting is preferably accomplished by cutting each fiber 16 proximate its juncture with the base material 14. Any suitable sharp cutting instrument can be used for the harvesting operation, but a razor blade or similar tool is preferred.

The harvesting step is accomplished by gripping the cutting tool, or razor blade 18, with one hand and gripping an individual fiber such as fiber 16A (FIG. 3) with the fingers of the other hand. A clean cut of the fiber is then made proximate the juncture of the fiber with the base material 14. Another fiber 16 is then harvested from a slightly different location in the pile surrounding the defect 12. This step is repeated until a sufficient number of individual fibers have been harvested to adequately fill the void left by the defect 12.

In the preferred form of the method of the invention, the fibers which have been harvested are soaked in a solution of alcohol and adhesive. While any number of clear drying adhesives may be used in the practice of the invention, Applicant has found that a latex adhesive manufactured and sold by Borden, Inc. of Columbus, Ohio, under the name and style of "ELMER'S" is quite satisfactory. In making the soaking solution the adhesive and alcohol, preferably isopropyl or denatured alcohol, is thoroughly mixed in a ratio of about one-third adhesive to about two-thirds alcohol to form a solution. Water may also be used as a dilutent. The individual fibers are submerged in the solution thus prepared and are allowed to remain there for about fifteen (15) to thirty (30) seconds. The fibers are then removed from the solution, separated and placed on a paper towel or other absorbing surface for a few minutes. The fibers are then separated and placed on a non absorbing surface to dry. The fibers prepared in this way tend to better adhere to the adhesive which is applied to the base material in the manner now to be described. When more viscous adhesives are used a greater amount of alcohol or water should be used in preparing the soaking solution. For example, 25 percent adhesive and 75 percent alcohol can be used.

The adhesive application step of the method of the present invention is illustrated in FIG. 2. This step involves the application of a layer of the clear drying adhesive to the base material in the area of the damage 12. The adhesive may conveniently be dispensed from a squeeze container 18 of the character shown in FIG. 2 having a dispensing nozzle 20. As previously mentioned, while various clear drying adhesives may be used in the practice of the invention, Applicant has found that latex base adhesives of the character manufactured and sold under the style "ELMER'S" will also produce satisfactory results in accomplishing this step of the method of the invention. Also a seaming adhesive sold by Roberts Consolidated, Inds. of the City of Industry, Calif., under the identification of "Roberts 0502" has proven satisfactory. Still another adhesive which can be used is manufactured and sold under the designation "710" by F. Taylor Co., Inc. of Sante Fe Springs, Calif.

In instances where the defect is in the nature of a severe burn in the carpet, it is advisable, prior to applying the adhesive, to clean the damaged area thoroughly using alcohol or other suitable solvent so as to remove any charred or loose fibers which remain in the defect area 12. In some instances it is advisable to cut the burned fibers away using a razor blade or other sharp instrument. Once the area has been cleaned, the adhesive is uniformly pooled onto the base surface 14 of the carpet. As indicated in FIG. 4, wherein the adhesive is generally designated by the numeral 22, the adhesive is applied liberally so as to thoroughly cover the base material 14 in the area of the defect 12.

Once the fibers or snips have dried, they are grasped either with the fingers or using tweezers 24 of the character illustrated in FIG. 4. Each individual dried fiber is gripped with the tweezers near it upper end and the lower end of the fiber is carefully implanted into the adhesive material 22. In accomplishing the implanting process, it is important that the fibers be implanted in a manner so as to as nearly as possible simulate the configuration of the pile, or fibers 16, which immediately surround the defect 12. Because the individual fibers have been harvested from the immediate area of the defect 12, each fiber exhibits virtually the same discoloration, wear and fading as the fibers in the immediate area of the defect 12. Accordingly, by carefully implanting the individual fibers in the adhesive 22, the correct color, extent of wear and pile pattern of the area surrounding the defect 12 can be closely duplicated. After the adhesive has dried to a clear form, the area of repair can be gently brushed and will become virtually invisible. After brushing, additional fibers can be added if necessary to more closely simulate the pile pattern. This is accomplished by dipping one end of the treated fibers into the adhesive and then emplacing the fiber in the repair area as required to effect an almost invisible repair.

Referring to FIG. 5 of the drawings, there is illustrated an alternate form of the method of the present invention. In instances where the carpet to be repaired is of a very light color and the defect consists of a serious burn, it is preferable to apply a tinting material such as paint to the base material 14 prior to the application of the adhesive to the base material. This paint or tinting material, identified in FIG. 5 by the numeral 26, can uniformly spread onto the base material using either a small brush, or using the index finger in the manner shown in FIG. 5. The paint or tinting material 26 should be applied to the base material in a quantity sufficient to completely mask the charred appearance of the fibers or base material in the area of the defect 12. Following drying of the tinting material, the various steps of the principal method of the invention as described in the preceding portion of the specification can then be followed to produce the desired repair.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method for repairing damaged carpet of the character having a base material supporting an upper fibrous layer or pile having a fiber pattern, comprising the steps of:

(a) cutting from an area in the vicinity of the damage a multiplicity of individual undamaged fibers;

(b) applying a layer of clear drying adhesive to the base material in the area of the damage; and (c) prior to the drying of the adhesive, inserting one end of each of said multiplicity of individual fibers into said adhesive in a pattern simulating the fiber pattern of the pile in the carpet being repaired.

2. A method as defined in claim 1 including the step of saturating said individual fibers with a solution of alcohol and adhesive prior to inserting said fibers into said adhesive applied to the base material.

3. A method as defined in claim 2 in which said adhesive comprises a latex material.

4. A method as defined in claim 2 in which said solution comprises one part adhesive and three parts alcohol.

5. A method for repairing a burn in a carpet of the character having a base material supported by an upper fibrous pile comprising the steps of:

(a) cleaning the base material in the area of the burn to substantially remove the burned fibers of the fibrous pile;

(b) selectively cutting proximate their juncture with the base material a multiplicity of fibers located within an area surrounding the burn to form a multiplicity of snips;

(c) soaking said snips in a solution of alcohol and adhesive for a period of time sufficient to saturate said snips;

(d) drying said snips;

(e) applying a layer of adhesive to the base material in the area of the burn;

(f) inserting one end of each of said individual dried snips into said adhesive in a manner to simulate the pattern of the pile of the undamaged carpet.

6. A method as defined in claim 5 including the step of applying to the cleaned base material in the area of the burn a thin layer of paint having substantially the color of the pile of the carpet.

* * * * *